United States Patent [19]

Summers et al.

[11] 4,294,382

[45] Oct. 13, 1981

[54] CONTAINER CLOSURE DEVICE

[75] Inventors: Kenneth L. Summers, Angola; Mahlon E. Rieke, Auburn, both of Ind.

[73] Assignee: Riche Corporation, Auburn, Ind.

[21] Appl. No.: 60,971

[22] Filed: Jul. 26, 1979

[51] Int. Cl.[3] ..... B67D 3/00

[52] U.S. Cl. ..... 222/529; 222/541; 222/562

[58] Field of Search ..... 215/251, 341, 343, 344, 215/354; 220/270, 288, 258, 257; 222/153, 478, 488, 527, 528, 529, 530, 539, 541, 562

[56] References Cited

U.S. PATENT DOCUMENTS

| | | | |
|---|---|---|---|
| 2,561,596 | 7/1951 | Rieke . | |
| 2,565,699 | 8/1951 | Rieke . | |
| 2,661,128 | 12/1953 | Rieke . | |
| 2,895,654 | 7/1959 | Rieke . | |
| 3,040,938 | 6/1962 | Smith . | |
| 3,278,089 | 10/1966 | Heekin et al. | 222/541 |
| 3,459,315 | 8/1969 | Labarre | 222/541 |
| 3,502,246 | 3/1970 | Kelbch | 222/529 |
| 3,604,740 | 9/1971 | Summers . | |
| 3,613,966 | 10/1971 | Summers . | |
| 3,804,305 | 4/1974 | Rieke . | |

FOREIGN PATENT DOCUMENTS

| | | | |
|---|---|---|---|
| 1204095 | 10/1965 | Fed. Rep. of Germany | 222/529 |
| 1417219 | 10/1965 | France | 220/258 |

*Primary Examiner*—H. Grant Skaggs

*Attorney, Agent, or Firm*—Woodard, Weikart, Emhardt & Naughton

[57] ABSTRACT

A cap-like closure device for a container which is arranged with a raised annular boss formed in one end to receive the closure device includes a flexible spout member secured to the raised annular boss by means of an anchor ring which is disposed overlapping the outermost edge of the flexible spout member and is crimpable to secure this outermost edge around the top lip portion of the raised annular boss. A resealable cap is provided which threadedly engages the top rim portion of the flexible spout and includes a depending annular groove in its top lip portion which is suitably sized to receive the top rim portion of the flexible spout to provide a secondary seal. Disposed over the resealable cap is a tamper-proof cap which is temporarily retained by the anchor ring, but which may be removed from beneath the innermost edge of the anchor ring by prying. Integral with the flexible spout member is a diaphragm which has joined thereto a pull tab ring member. A pull force on the pull tab ring member and directed upwardly enables the diaphragm to be torn free of the flexible spout member and thereby open the container. Also joined to the flexible spout member is a venting unit which includes a plurality of venting apertures to enable the entry of air for the smooth and continuous discharge of container contents.

1 Claim, 14 Drawing Figures

CONTAINER CLOSURE DEVICE

BACKGROUND OF THE INVENTION

This invention relates in general to closure devices and in particular to container closure devices which are secured around a container opening and include a collapsible, flexible spout, a tamper-proof seal and resealable cap.

The evolution of present-day container closure devices of a type similar to that disclosed by the present invention can be traced from as early as the mid 1940' by a review of the developments and improvements which are disclosed in the following chronologically arranged list of patents.

| Patent No. | Patentee | Issue Date |
|---|---|---|
| 2,561,596 | Rieke | 7/24/51 |
| 2,565,699 | Rieke | 8/28/51 |
| 2,661,128 | Rieke | 12/01/53 |
| 2,895,654 | Rieke | 7/21/59 |
| 3,040,938 | Smith | 6/26/62 |
| 3,604,740 | Summers | 9/14/71 |
| 3,613,966 | Summers | 10/19/71 |
| 3,804,305 | Rieke | 4/16/74 |

Rieke (U.S. Pat. No. 2,561,596) discloses a pouring spout which is nestable within a container and is extendable to a pouring orientation and contractable to a nested orientation. The spout is initially disposed in a closed arrangement by an integral portion which must be cut or slit in order to allow the contents to be poured from the container. The outer periphery of the pouring spout is secured to the container opening by means of a clamping ring of light metal which is readily deformed by a hand-operable crimping tool.

Rieke (U.S. Pat. No. 2,565,699) discloses a flexible, retractable dispensing spout normally nestable within a container and mounted in an opening therein. A junction portion signifies the point of union between the outer cap member, which forms the base of the extended spout, and the inner spout portion. The spout is sealed by a closure portion comprising a seal which is located immediately contiguous to the junction portion. The seal includes an integral pull member which extends upwardly from the seal and is located quite close to the inside surface of the spout portion. Removal of the seal is accomplished by the use of a tool, such as pliers, which have a suitable narrow-nose design in order to be able to grip the pull member without interfering with the inside surface of the spout portion.

Rieke (U.S. Pat. No. 2,661,128) is a continuation-in-part patent of patents Rieke (U.S. Pat. No. 2,561,596) and Rieke (U.S. Pat. No. 2,565,699) and further discloses a tamper- and seal-proof flexible pouring spout. A tamper-indicating seal is disposed over the end of the spout and may include a semi-severed, tear-out portion which must first be removed in order for the tamper-seal indicator to be removed. Alternatively, this tamper-indicating seal may be removed by a prying action. Disposed within the spout opening at the uppermost end is an integral plug which is joined to the inside periphery of the spout by means of an annular weakened junction which must be severed with a knife in order to open the spout.

Rieke (U.S. Pat. No. 2,895,654) discloses a bail handled closure cap of a character to be internally threaded for screw threading into closing position upon an externally threaded member, such as a container neck, spout or the like. The bail is connected with the cap through opposed and substantially diametrically extending bosses by means of suitable hinged arrangements.

Smith discloses a vented pour spout wherein a venting unit is rigidly secured to the inside surface of a flexible pour spout, of the type disclosed by the prior listed patents. This venting unit permits the entry of air into the container so as to enable a smooth, continuous flow of fluid from the container by way of the pour spout.

Summers (U.S. Pat. No. 3,604,740) discloses a container closure combination which is anchored into a container opening by means of a boss and circular anchor ring. The container is plastic and the boss includes an upwardly protruding lip which is sandwiched within an inverted U-shaped annular portion of the closure. The anchoring ring is disposed about the annular portion and when crimped together holds the members together. This arrangement precludes any separation or leakage at the closure, thereby overcoming typical cold flow characteristics of those plastics which are usually employed in such arrangements.

Summers (U.S. Pat. No. 3,613,966) discloses a nestable pouring spout with a wall-supporting cap of the style that includes an elongated skirt portion. This elongated skirt portion extends coaxially with the neck and body portions of the spout to a point near the intersection of these two portions. The space between the neck portion and body portion at this intersection location is large enough to permit easy removal of the cap and is small enough to permit the skirt portion to support the body portion and avoid stress cracking due to unrestrained movement of the body portion in response to internal container pressure.

Rieke (U.S. Pat. No. 3,804,305) discloses a container closure concept which includes a flanged overseal closure member having a central cap portion, an intermediate portion and a rim portion.

While each of these prior art devices has its own certain improvements and advantages, the structure required to achieve one set of improvements is not necessarily compatible with the structure required to achieve another, different set of improvements. When one aspect or portion of a part is revised in an effort to achieve an added improvement, the revision may alter or adversely influence other, already-achieved improvements and prevent the attainment of both improvements simultaneously. Heretofore, there has not been a structural combination realized which is suitable to achieve all of the various improvements of the seven listed patents. However, the present invention by incorporating a number of component and structural changes, does in fact provide a complete combination of structural feature improvements as well as providing yet further improvements to the overall container closure cap concept as will be apparent from the following description.

SUMMARY OF THE INVENTION

A cap-like container closure device of the type having a flexible spout member with a substantially cylindrical top rim portion and an outer edge portion, a retainer for securing the outer edge portion of the flexible spout member to a container, a first cap for engaging the top rim portion and for closing the spout member, and a tamper-proof cap disposed over and removable from the top of the first cap according to one embodiment of the present invention comprises an interior annular groove disposed in a top lip portion of the first cap and opening downwardly toward the top rim portion of the flexible spout member, the interior annular groove has a diameter size substantially equal to the diameter size of the top rim portion and is suitably arranged for receipt of the top rim portion therein for a secondary seal.

One object of the present invention is to provide an improved cap-like container closure device.

Related objects and advantages of the present invention will be apparent from the following description.

DESCRIPTION OF THE PREFERRED EMBODIMENT

Figure 1:
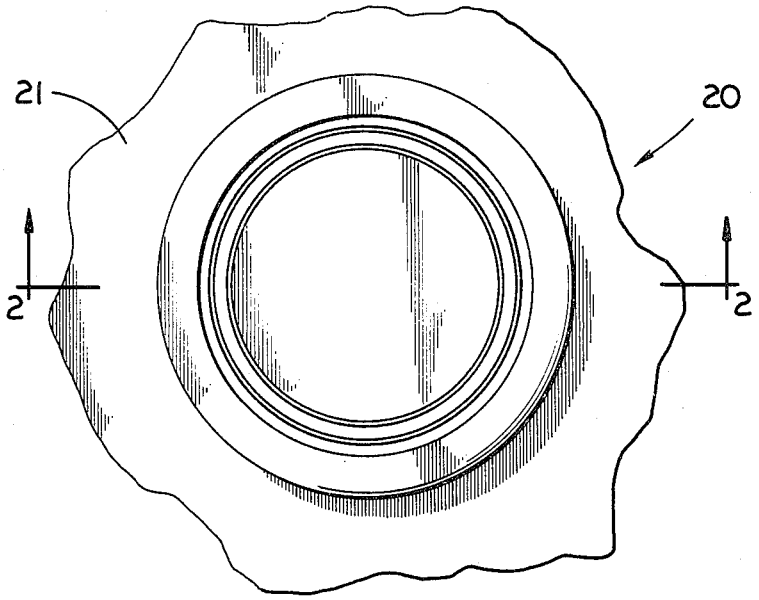
FIG. 1 is a top plan view of a cap-like container closure device according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
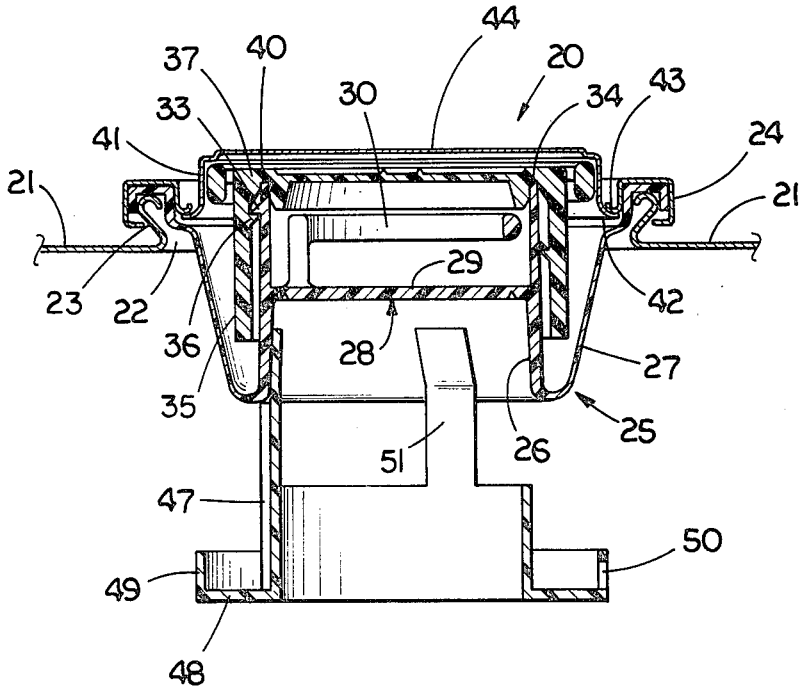
FIG. 2 is a front elevation section view of the FIG. 1 cap-like container closure device as taken along line 2—2 in FIG. 1

Referring to FIGS. 1 and 2, there is illustrated a cap-like closure device 20 which is attached to container 21 by means of an outer peripheral seal arrangement. There are five component parts which comprise cap-like container closure device 20 and these five component parts are detailed in FIGS. 3–8. While the relationship between these various component parts will be discussed with reference to FIG. 2, reference should also be made to FIGS. 3–8 in order to obtain a complete understanding of the individual component part structures.

Figure 9:
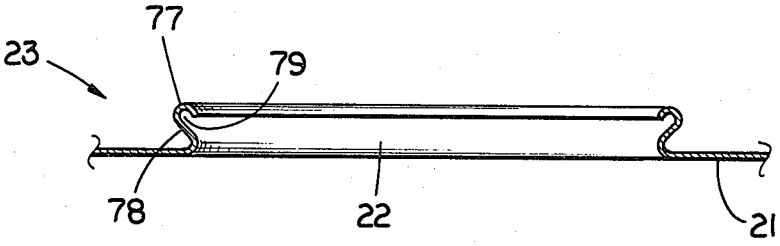
FIG. 9 is a front elevation section view of a container opening boss portion suitable for receiving the FIG. 1 cap-like container closure device in a sealed arrangement.

Container 21 includes a discharge opening 22 which is surrounded by a raised annular boss 23 (see FIG. 9). Secured to this raised annular boss by means of anchor ring 24 is a flexible spout member 25 which is shown in a nested orientation in FIG. 2. Flexible spout member 25 includes an inner portion 26, an outer portion 27 and an invertible fold portion therebetween. Disposed integrally with and internal to inner portion 26 is a full-diameter integral seal 28 which includes a diaphragm 29 and an integral pull tab ring member 30. The outside diameter surface of inner portion 26 includes a threaded portion 33 and a top rim portion 34. Although diaphragm 29 provides a temporary closure to inner portion 26, an upwardly exerted force on pull tab ring member 30 enables diaphragm 29 to be torn out and the seal is thus defeated. Repeated opening and closing of the container is accomplished effectively by means of resealable cap 35.

Resealable cap 35 has an internally threaded portion 36 of a suitable diameter and pitch to engage with threaded portion 33, and resealable cap 35 further includes an enclosing, full-diameter top lip portion 37. Top lip portion 37 includes therein an interior annular groove 40 opening downwardly toward top rim portion 34 of flexible spout member 25. The diameter measurement to the centerline of interior annular groove 40 is substantially equal to the diameter measurement to the centerline of top rim portion 34 and the respective width dimensions of groove 40 and rim portion 34 are such so as to provide a snug fit. Due to the size and position compatibilities of this arrangement, as reasealable cap 35 is threaded onto spout portion 26, top rim portion 34 will fit snugly up within interior annular groove 40 as is illustrated by the enlarged detail of FIG. 10. Interior annular groove 40 is configured with a unique series of differently shaped portions which will be described in greater detail hereinafter. Compatible with these differently shaped portions is the design of top lip portion 34 which includes an upwardly and outwardly inclined interior surface 34*a* (see FIG. 6*a*) terminating in a somewhat sharp outer edge 34*b*.

In order to assure that chemicals and other supplies which are shipped in containers fitted with a closure device similar to device 20 remain intact and are not tampered with, it is beneficial to have a tamper-proof cap or similar component disposed over the outermost portion of the closure device. In addition to preventing tampering with the contents, such a cap also serves as an indication of whether or not there have been attempts to tamper with the container. A tamper-proof cap is illustrated by cap 41 whose outer peripheral lip 42 is overlapped by the inner lip 43 of anchor ring 24. In the particular arrangement illustrated, tamper-proof cap 41 is not able to be removed from its retained position under the inner lip of anchor ring 24 unless anchor ring 24 is deformed or in some manner altered. In the exemplary embodiment top surface 44 is continuous throughout and cap 41 is deformed by an inward prying action. There is sufficient clearance as well as flexibility with respect to resealable cap 35 to enable cap 41 to be worked free from beneath inner lip 43.

However, in an alternative embodiment, tamper-proof cap 41 may include a semi-severed tear-out portion disposed in its top surface and the material for tamper-proof cap 41 is a relatively thin-gauge metal or plastic, either one of which will tear upon being subjected to a suitable pull force. A typical tear-out portion includes a centrally disposed tab having a free end which is suitable as to size and location to be gripped by a conventional removal tool such as a pair of pliers. When this tab is pulled on in an upwardly and outwardly manner, toward the outside periphery of the tamper-proof cap, the tear-out portion is actually torn away from the remainder of the tamper-proof cap. The tamper-proof cap is then able to be deformed and worked out from under the inner lip 43 of anchor ring 24, removed and discarded.

Joined to the inside surface of inner portion 26 is a generally cylindrical venting unit 47 which includes an outwardly extending flange 48, a raised annular edge 49 and a plurality of venting apertures 50 which are disposed in a spaced apart relationship around the circumference of raised annular edge 49. Venting unit 47 is secured to the inside diameter surface of inner portion 26 by means of three tongues 51 which are heat-welded to the inside surface or alternatively may be joined by a number of suitable techniques such as the use of cement or adhesive. Venting unit 47 extends downwardly from its point of attachment to inner portion 26 a sufficient distance so as to position the uppermost surface of edge 49 against the inside of flexible spout member 25 when spout member 25 is fully extendined to a pouring orientation.

While the general relationship of the five component parts has been discussed and referred to in FIG. 2, a description will now be provided of each of these five component parts individually and the specific structural features which are important to the functioning of cap-like closure device 20.

Figure 3:
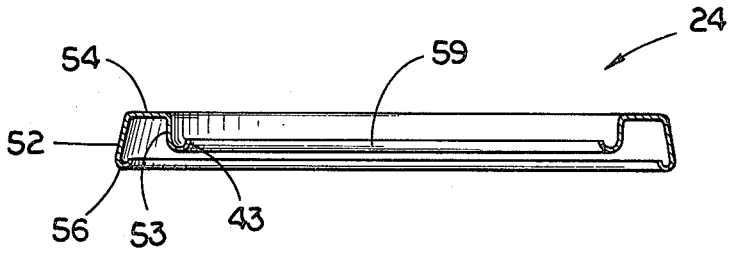
FIG. 3 is a front elevation section view of an anchor ring comprising a portion of the FIG. 1 cap-like container closure device.

Referring to FIG. 3, anchor ring 24 is illustrated in greater detail and the front elevation section view provided indicates the general structural and positional relationships between the inner lip 43, the outer lip 56 and the three surfaces therebetween. Outer surface 52 in combination with inner surface 53 and top surface 54 provide an inverted U-shaped annular groove which is compatibly sized and arranged to fit over the annular mounting portion 55 of flexible spout member 25 (see FIG. 6). The inside surface of inner lip 43 defines a circular clearance opening 59.

Figure 4:
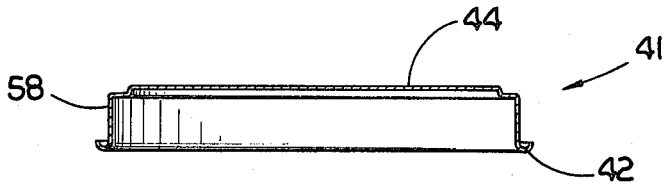
FIG. 4 is a front elevation section view of a tamper-proof cap comprising a portion of the FIG. 1 cap-like container closure device.

Referring to FIG. 4, tamper-proof cap 41 is illustrated, and the outside diameter size of raised portion 58 is just slightly smaller than the diameter size of clearance opening 59 in anchor ring 24. The stacked arrangement of FIGS. 3–7 is in effect an exploded view of the illustrated component parts of FIG. 2 and as such the size perspective relationships between the component parts is approximately correct. It is intended to be illustrated that inner lip 43 of anchor ring 24 overlaps outer peripheral lip 42 of tamper-proof cap 41 as raised portion 58 extends upwardly through clearance opening 59.

Figure 5:
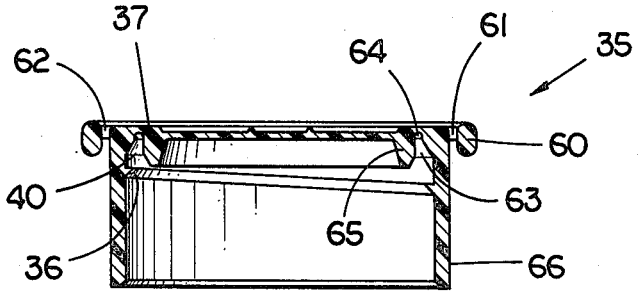
FIG. 5 is a front elevation section view of a resealable cap comprising a portion of the FIG. 1 cap-like container closure device.

Referring to FIG. 5, resealable cap 35 is illustrated in greater detail. As has been previously disclosed, resealable cap 35 includes an internal thread 36 and a top lip portion 37 which has disposed therein an interior annular groove 40. Integral with top lip portion 37 and positioned exterior thereto is a bail handle 60. Handle 60 is arranged into two substantially semicircular portions which are joined to the outer periphery of top lip portion 37 by means of fingers 61 and 62 which are substantially diametrically opposite to each other. The thickness of each bail handle portion is reduced at the point of connection to fingers 61 and 62, and these reduced-thickness portions resiliently bend when bail handle 60 is raised and pulled upwardly. The use of bail handle 60 provides a convenient means for the extending of flexible spout 25, and the two bail handle portions actually pivot upwardly and inwardly whereby they are drawn together during the extension of the spout.

At this point it should be understood that the FIG. 2 orientation of flexible spout 25 was a nested orientation yet this flexible spout is extendable upwardly into a pouring orientation and this extending action is easily achieved by the use of bail handle 60. Of course, it is important that the resealable cap be threadedly engaged onto inner portion 26 when bail handle 60 is utilized.

Figure 5A:
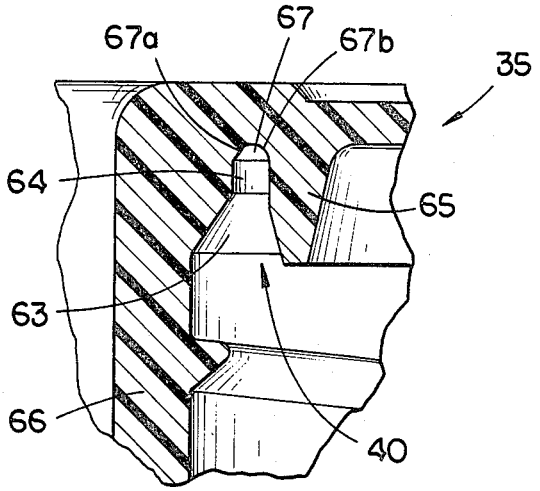
FIG. 5*a* is a partial enlarged detail view of the FIG. 5 cap.
Figure 10:
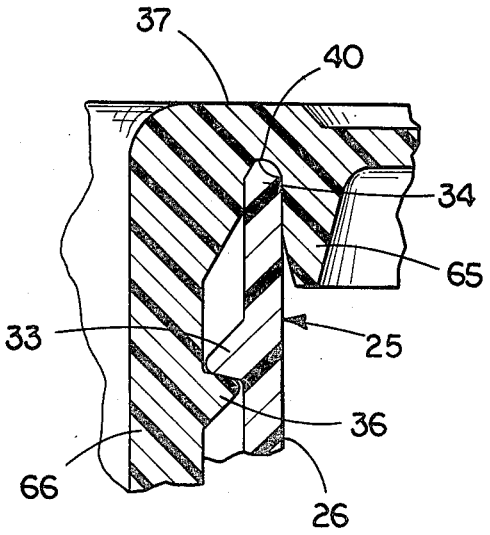
FIG. 10 is an enlarged partial detailed view of a secondary seal between the FIG. 5 resealable cap and the FIG. 6 flexible spout.

Interior annular groove 40 is actually configured into three portions (see FIG. 5*a*). First portion 63 is of an enlarged, inwardly tapering shape terminating into intermediate portion 64. The third portion 67 (the base of groove 40) includes a slanted outer surface 67*a* and a curved inner surface 67*b*. The configuration of these surfaces and their position relative to the remainder of groove 40 and rim portion 34 enhance the integrity of the secondary seal. While all portions are positioned between depending lip 65 and generally cylindrical skirt portion 66, the inwardly tapering configuration enables a type of self-alignment for top rim portion 34 of inner portion 26 as the resealable cap is threadedly mated with inner portion 26. As outer edge 34*b* advances upwardly into groove 40, it is directed inwardly into portion 64 and although there is a snug fit between portion 34 and portion 64, this fit becomes even tighter as edge 34*b* advances into portion 67. Due to the reduced width size of portion 67, edge 34*b* curls or bends inwardly until achieving the FIG. 10 configuration. This force fit between portion 67 and edge 34*b* provides a secure secondary seal regardless of minor tolerance and dimensional variations often found with plastic parts. FIG. 10 is an illustration of the resealable cap in full engagement with the spout member and it is this full threaded engagement which assures a tight fit of edge 34*b* into portion 67. Skirt portion 66 extends downwardly from top lip portion 37 to an extended length which is sufficient to place the lower part of skirt portion 66 within annular open area 69 between inner portion 26 and outer portion 27 when flexible spout member 25 is in a nested orientation (see FIG. 6).

Figure 6:
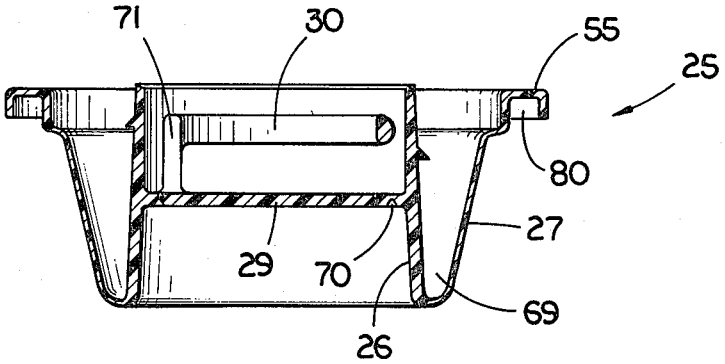
FIG. 6 is a front elevation section view of a flexible spout comprising a portion of the FIG. 1 cap-like container closure device.
Figure 6A:
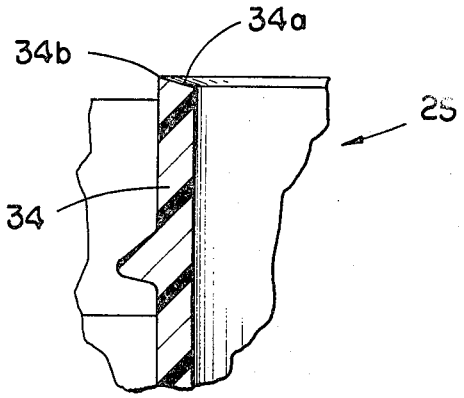
FIG. 6*a* is a partial enlarged detail view of the FIG. 6 spout.

Referring to FIG. 6, flexible spout member 25 is illustrated in greater detail. Although a majority of the various structural characteristics and features of flexible spout member 25 have previously been discussed, it is to be noted that diaphragm 29 is joined to the internal surface of inner portion 26 by a reduced-thickness annular membrane 70 which extends in a circular path between the outer edge of diaphragm 29 and the inside diameter of inner portion 26 and has the general appearance of a notch resulting in a reduced material thickness. It is this reduced-thickness annular membrane 70 which actually tears apart when pull tab ring member 30 is pulled upwardly in order to defeat the seal and open the container.

Pull tab ring member 30 is connected to diaphragm 29 by means of a dual-branch raised stem member 71 which is integral with both diaphragm 29 and pull tab ring member 30. Although raised stem member 71 is disposed very close to the interior wall of inner portion 26 and is difficult to grip, stem member 71 is not the part which must be gripped in order to tear out diaphragm 29 and thereby defeat integral seal 28. Rather, it is pull tab ring member 30 which is used, and member 30 is elevated above diaphragm 29 and is substantially parallel therewith and extends from raised stem member 71 in a circular ring around the inside diameter of inner portion 26. Therefore, member 30 is readily accessible for being gripped manually by placing the index finger inside and underneath the ring shape of member 30. The particular configuration of pull tab ring member 30 in combination with raised stem member 31 and diaphragm 29 provides an improved seal removal arrangement in that the pull tab member is more accessible and the seal may be defeated without the need of pliers or other tools.

Figure 7:
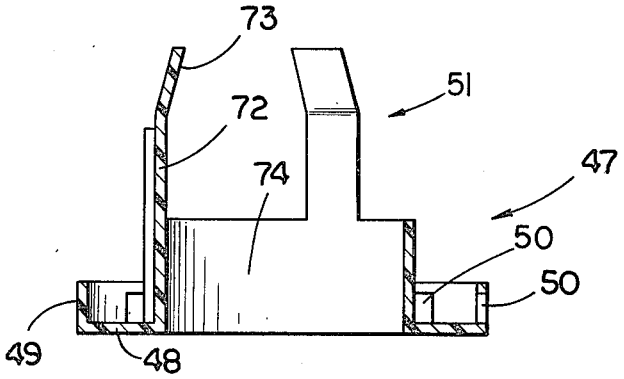
FIG. 7 is a front elevation section view of a venting unit comprising a portion of the FIG. 1 cap-like container closure device.

Referring to FIG. 7, venting unit 47 is illustrated in greater detail. A majority of the features of this unit has been previously described, but it is to be pointed out that the tongues 51 have a two-part configuration. The first portion or part 72 extends upwardly from flange 48 and is substantially perpendicular to flange 48. Second portion or part 73 is integral with first part 72 and is inclined inwardly toward the centerline of venting unit 47.

Figure 8:
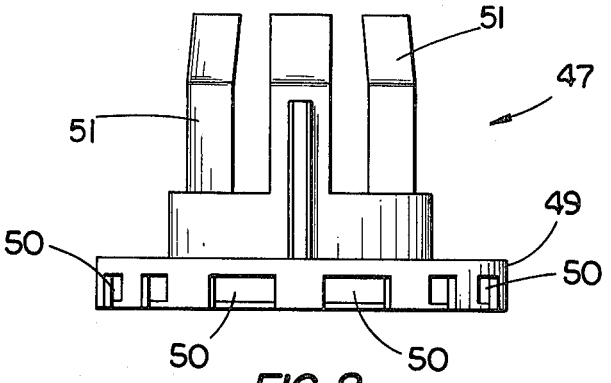
FIG. 8 is a front elevation view of the FIG. 7 venting unit.

The front elevation view of FIG. 8 further aids the understanding of the particular structure of this component part, and it should be apparent that as inner portion 26 is pulled from its nested orientation to an extended pouring orientation, that the venting unit 47 will be drawn into proper position within the pouring spout. Then, as the container is tilted through various pouring orientations, the contents of the container will pass both through venting apertures 50 as well as through the central clearance portion 74. The contents of the container will pass through those venting apertures 50 which are submerged and those apertures which are not submerged will allow venting air to pass therethrough. Venting apertures 50 are spaced to provide substantially equal venting area per unit of peripheral length around the raised annular edge 49 of venting unit 47 and thus venting unit 47 may be installed onto flexible spout 25 without requiring the installer to first orient or register the venting unit with respect to the flexible spout.

Referring to FIG. 9, raised annular boss 23 of container 21 includes a top rim 77, a flanged margin 78 and an annular groove 79 therebetween. It is also to be noted that the annular mounting portion 55 of flexible spout member 25 includes an inverted U-shaped annular groove 80 (see FIG. 6) and it is this groove which accepts top rim 77 of container boss 23. Once this mating engagement is achieved, anchor ring 24 is placed over annular mounting portion 55 and is crimped thereto at which time top rim 77 is securely sandwiched within annular groove 80 thereby providing a fluid-tight, rigid seal between the cap-like container closure device 20 and the container 21.

Figure 11:
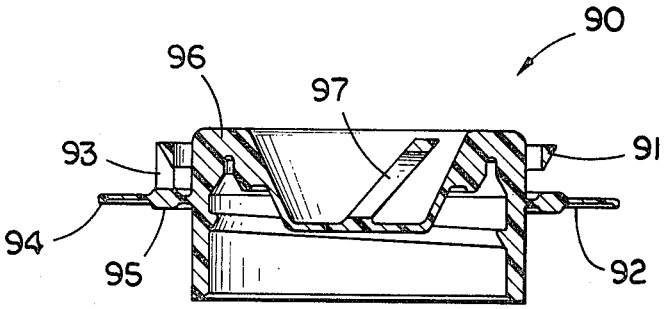
FIG. 11 is a front elevation section view of a combined tamper-proof cap and reasealable cap comprising an alternative arrangement of the FIG. 1 cap-like container closure device.
Figure 12:
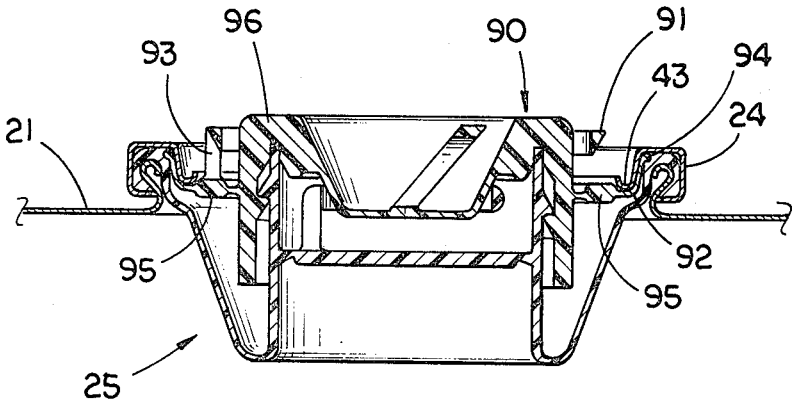
FIG. 12 is a front elevation section view of the FIG. 11 cap assembled into the FIG. 1 cap-like container closure device.

A further embodiment of the disclosed invention involves a unique combination of the concepts of tamper-proof cap 41 and resealable cap 35. Illustrated in FIGS. 11 and 12 is a single cap member 90 which is resealable onto spout member 25 and provides a means of tamper-proof indication. Cap member 90 includes a pull ring 91 secured to flange 92 by stem 93. Flange 92 is configured with an outer rim portion 94 and an intermediate portion 95 which is located around resealable cap 96.

Referring to FIG. 12, cap member 90 is illustrated in assembled combination with the remaining component parts of closure device 20. Outer rim portion 94 is securely sandwiched between inner lip 43 of anchor ring 24 and mounting portion 55 of spout member 25. Intermediate portion 95 is disposed interior of the innermost extent of lip 43 such that when a sufficient lifting force is applied to pull ring 91, the pull ring 91, stem 93 and intermediate portion 95 are separated from cap member 90 thus allowing removal of resealable cap 96.

A further detail of cap member 90 should be noted and this involves the location of the bail handle for extension of flexible spout member 25. With the combining of the tamper-proof and resealable cap concepts, pull ring 91 occupies the space previously occupied by handle 60. Consequently, handle 97 is disposed interior to resealable cap 96 and is ring-shaped for easy manual gripping.

Container closure device 20 provides a unique combination of features not herebefore provided in a single unit. Each of the various structural component parts have been arranged and designed to both achieve their prior beneficial improvements and advantages while remaining compatible with yet other improvements and advantages for which they are a contributing factor. In addition to achieving a first-time accumulation of all beneficial container closure device improvement features, the present invention also provides additional improvement advantages. One additional advantage is the providing of a very secure and tight secondary seal by means of the engagement of outer edge 34*b* of top rim portion 34 within portion 67 of interior annular groove 40. The configuration of groove 40 results in the providing of depending lip 65 and the size and location of this lip results in greater rigidity to the cap. Another improvement provided by the present invention is the configruation and positioning of pull tab ring member 30. This ring member is easily accessible and usable to manually rupture the diaphragm to defeat integral seal 28, and thus obviates the need for a cutting or rupturing tool. A still further improvement is the incorporation into a single cap member both the tamper-proof cap concept and the resealable cap concept.

While the invention has been illustrated and dscribed in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A cap-like closure device for a container of the type including a flexible spout member having a substantially cylindrical top rim portion and an outer edge portion and extendable from a nested orientation to a pouring orientation, an anchor ring for securing the outer edge portion of the flexible spout member to the container, a first cap for engaging the top rim portion and closing said spout member, and a tamper-proof cap disposed over and removable from the top of said first cap, wherein the improvement comprises:

an interior annular groove disposed in a top lip portion of said first cap and including a base surface at the uppermost end, said interior annular groove opening downwardly toward said top rim portion of said flexible member, wherein said interior annular groove narrows as it extends upwardly away from the top rim portion of said flexible spout member, and wherein said top rim portion has an upwardly and outwardly inclined top surface which tapers to an edge at the outermost and uppermost location of said top rim portion, the width of the interior annular groove at said base surface is narrower than the maximum thickness of said top rim portion thereby forcing the thinner parts of said top rim portion corresponding to the inclined top surface to curl into said interior annular groove when said first cap is fitted onto said flexible spout member.

* * * * *

UNITED STATES PATENT AND TRADEMARK OFFICE

CERTIFICATE OF CORRECTION

PATENT NO. : 4,294,382
DATED : October 13, 1981
INVENTOR(S) : Kenneth L. Summers & Mahlon E. Rieke It is certified that error appears in the above-identified patent and that said Letters Patent are hereby corrected as shown below:

On the Title Page
the Assignee's name is incorrectly listed as "Riche Corporation" and should be changed to --Rieke Corporation--.

Signed and Sealed this
*Twenty-sixth* Day of *January 1982*

[SEAL]

*Attest:*

GERALD J. MOSSINGHOFF

*Attesting Officer*

*Commissioner of Patents and Trademarks*